United States Patent [19]

Myers

[11] 4,186,564

[45] Feb. 5, 1980

[54] AIR VENTILATION SYSTEM

[76] Inventor: Melvin Myers, 1621 Gulf Blvd., Clearwater, Fla. 33515

[21] Appl. No.: 836,002

[22] Filed: Sep. 23, 1977

[51] Int. Cl.[2] ..... F24F 3/00

[52] U.S. Cl. ..... 62/180; 62/410; 165/16; 236/13; 236/49

[58] Field of Search ..... 62/180, 410; 165/16; 236/13, 49

[56] References Cited

U.S. PATENT DOCUMENTS

| | | | |
|---|---|---|---|
| 3,887,127 | 6/1975 | Jauss | 236/49 X |
| 3,927,713 | 12/1975 | Gilles | 165/16 |
| 4,037,783 | 7/1977 | Bradford | 236/49 |

FOREIGN PATENT DOCUMENTS

| | | | |
|---|---|---|---|
| 1291724 | 3/1962 | France | 236/13 |

OTHER PUBLICATIONS

Haines, Roger W., *Control Systems for Heating, Ventilating and Air Conditioning,* 1971, Van Nostrand Reinhold Co., N.Y. p. 70–73.

*Primary Examiner*—Robert Mackey

*Attorney, Agent, or Firm*—Daniel M. Rosen

[57] ABSTRACT

An economizer system for air conditioning uses a space thermostat to determine a demand for cooling and an outside air controller to determine whether cooling shall be mechanical or natural. A mixed air controller senses the temperature of the mixture of outside air and recirculated air and adjusts the relative proportions as desired by means of a controlled bidirectional damper, moving at a rate far less than the response time of the mixed air controller. This slow bidirectional damper movement in response to the mixed air control sensors causes the dampers to modulate in an inexpensive and reliable manner.

12 Claims, 4 Drawing Figures

Fig. 1.
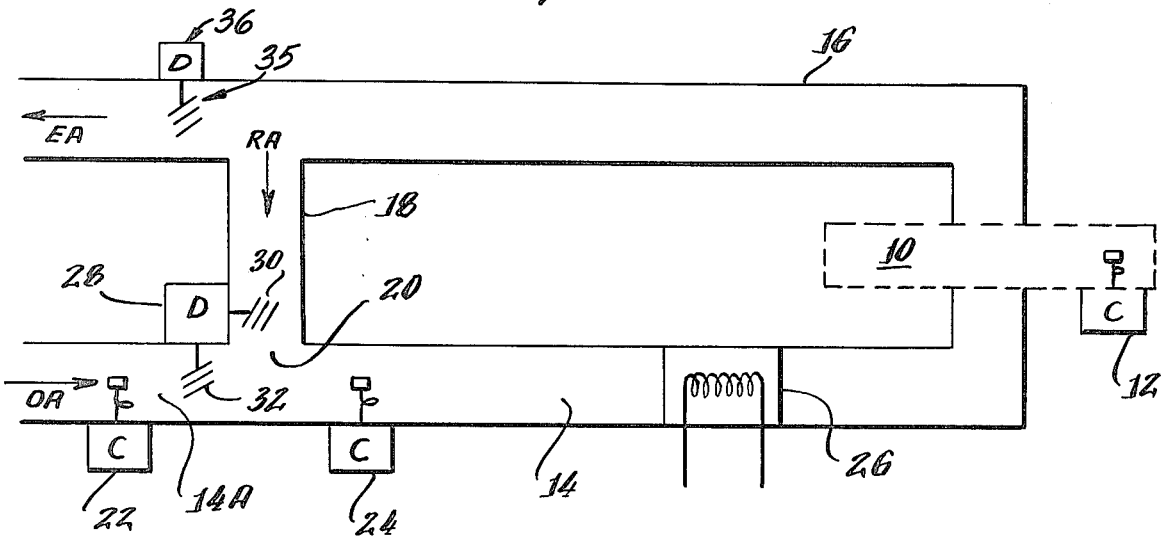
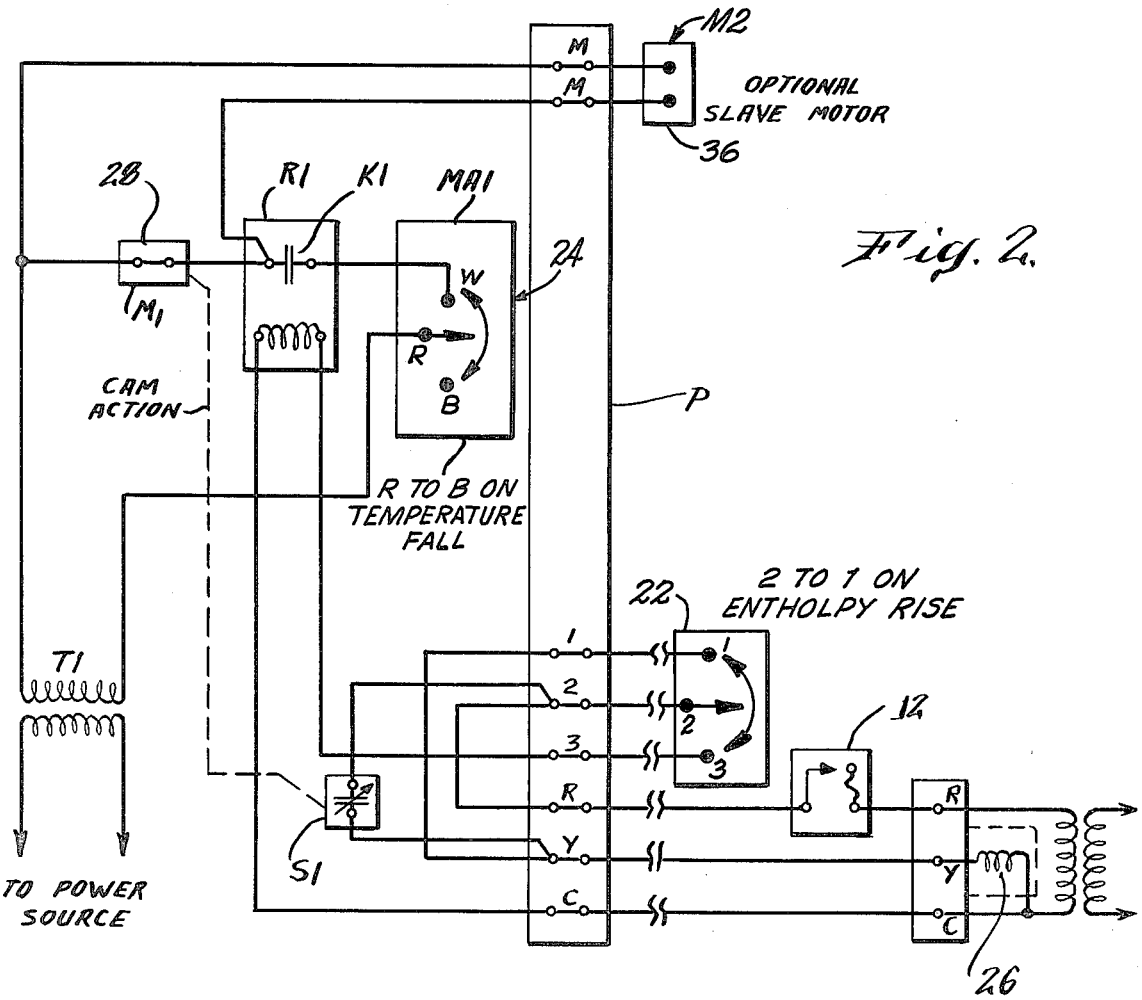
Fig. 2.

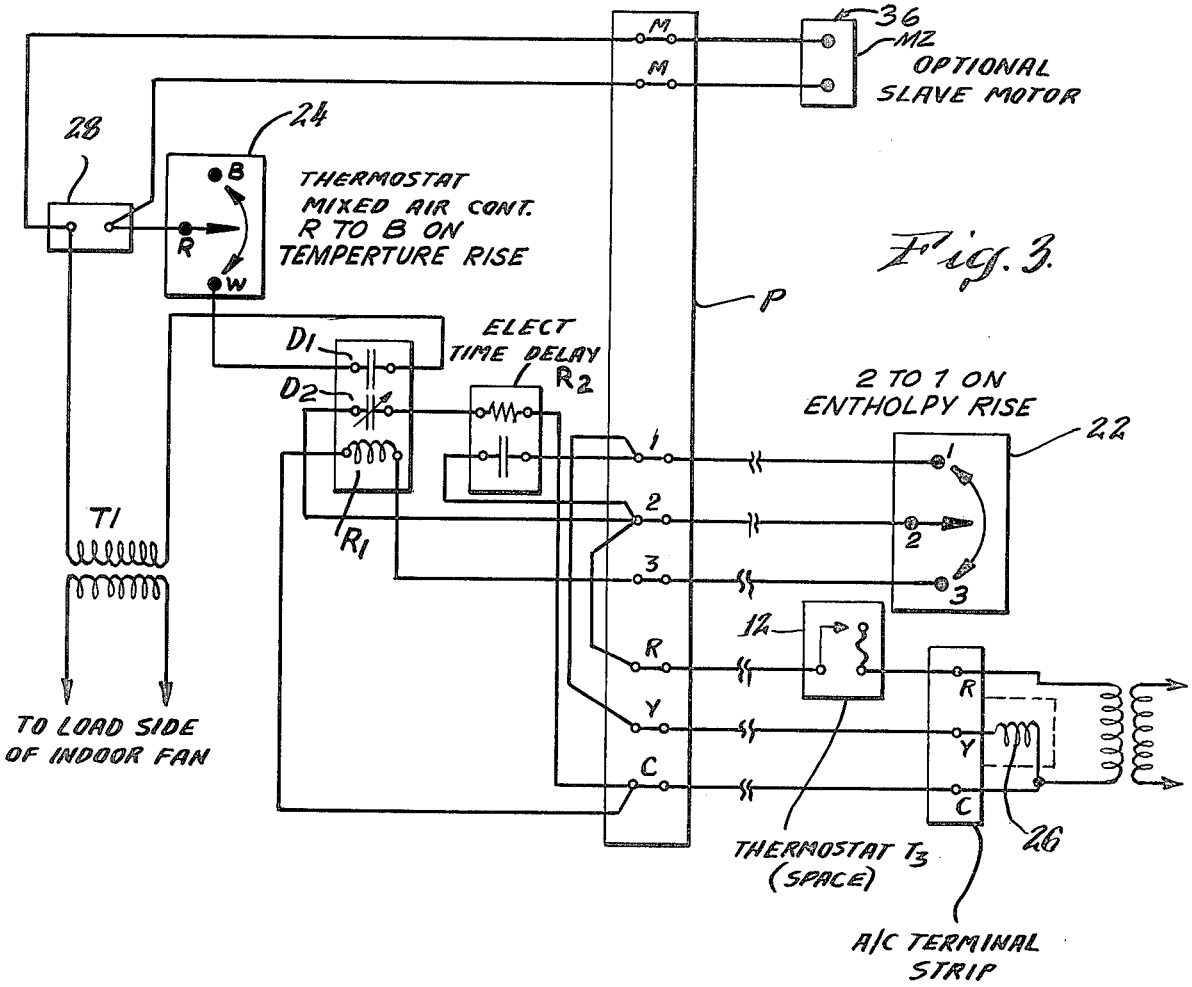
Fig. 3.
Fig. 4.
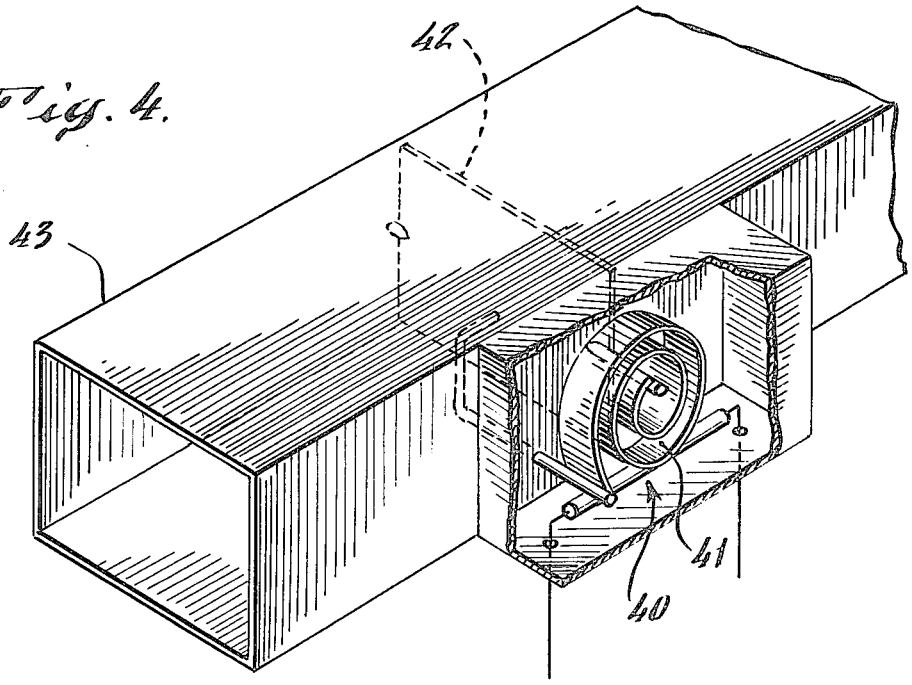

AIR VENTILATION SYSTEM

BACKGROUND OF THE INVENTION

This invention relates to air conditioning systems and particularly to systems employing both mechanical and natural cooling modes.

In modern air conditioning systems, efficiency and economy may be improved by utilizing the effects available with respect to outside air. In cooling systems particularly, natural cooling can be used when a demand for cooled air is initiated and when the outside air is cool enough and of a sufficient quality level which may be employed to satisfy that demand. By using natural cooling when possible and mechanical cooling at other times, a total system of greater economy and efficiency is achieved.

In a conventional automatic cooling system employing both natural and mechanical cooling systems, termed an "economizer system," a damper controlled vented ductwork is utilized. In a basic system, air is recirculated from the conditioned space into a mixing chamber. The mixing chamber also receives outside air from an outside air inlet. When cooling is demanded, and natural cooling can be employed, air is admitted from the outside air inlet through the mixing chamber into the space to be conditioned. When cooling is demanded and natural cooling is not available, then mechanical cooling is employed, principally on recirculated air. Outside air dampers are then closed, although partial admittance of outside air may be employed for fresh air ventilation.

The control systems conventionally employed for the foregoing described functions are of two basic types. In the first, a motor is employed to drive the damper in the outside air inlet duct. To control the motor at a fixed point and to prevent hunting or oscillation about the desired setting, a balancing potentiometer control system is employed. In such systems, the controller potentiometer and motor feedback potentiometer, together with a balancing relay, form a bridge circuit. As long as the value of the controlled medium remains at the controller set point, the circuit is balanced and the motor does not run. When the value of the controlled medium changes, the potentiometer wiper in the controller is moved. This unbalances the circuit and more current flows through one half of the balancing relay. The relay closes and runs the motor in the appropriate direction to correct for the imbalance. As the motor runs, the feedback potentiometer wiper moves to rebalance the circuit and stop the motor.

Thus, the motor will be activated in accordance with the settings of an appropriate controller and rapidly move to a position determined by the balancing of the potentiometer. The damper thus undergoes a series of rapid movements between successive fixed points determined by the controller settings and thereby modulates over a desired range, thus modulating the flow of outside air as desired. While this modulating action is desirable and effective, this requires the use of at least one relatively expensive motor and balancing relay control system.

In a control system of a second type, a slower moving motor without balancing relays has been employed to control outside air entry. In this case, a thermostat within the conditioned space demands cooling and a controller sets the outside air damper motor in either an on or off position. In this case, if natural cooling is available, the mechanical cooling will not come on and the outside damper will remain open until the space thermostat is satisfied. In this conventional system, the damper will regulate the outside air in response to the room thermostat and thus may create overshoot situations or at least permit the conditioned space temperature to oscillate about the desired set point by a wider margin.

It is the object of the present invention to provide an economizer system that will achieve the more precise control available with a modulating damper but without the use of expensive motors, balancing potentiometers, and balancing relays.

It is a further object of the present invention to enable a less expensive type of damper drive to be used with a control system that will provide a more precise control of the air temperature so as to provide a relatively narrower variation about a set point.

SUMMARY OF THE INVENTION

The foregoing objects are achieved, in accordance with the invention, by providing an air ventilation and conditioning system with a novel and unique combination of damper drive components and controller points. Briefly, the system is provided with a space thermostat control, presettable within a range at a point determining whether the space is to be cooled. An outside air controller determines the cooling mode, mechanical or natural, when cooling is demanded by the space thermostat. A mixing chamber receives a damper controlled flow of outside air and return air. A mixed air controller is positioned to sense the temperature of the mixed air. The mixed air controller is settable at a temperature within a range of ambient temperatures and has a preset differential at any settable temperature within that range. A control means including a damper drive responds to the mixed air controller and acts to move the outside air damper across its entire operating range at a slow and substantially constant rate in either of its two directions. By providing the rate of movement of the control means to be much slower than the response rate of the mixed air controller, a modulating damper movement is achieved over a narrow range; the range being determined by the differential of the mixed air controller. The mixed air controller thereby modulates the damper controlling the relative proportions of outside air and recirculated air.

The foregoing damper drive utilized with the system of the invention preferably employs a heat motor, composed of a bimetallic strip, which can be directly coupled to a damper for driving over a typical 90° operating angle.

Temperature sensing is provided by standard snap acting instead of proportional thermostats. The location of these devices as described above in the vicinity of the mixing chamber, in the outside air inlet, and in the area to be conditioned, provides a control system that is more effective and economical than prior art systems to correct temperature deviations in the area to be conditioned.

DESCRIPTION OF THE DRAWINGS

The foregoing brief description of the present invention will become more apparent from the following more detailed description and appended drawings of a preferred embodiment, wherein:

FIG. 1 is a schematic diagram of an air ventilation system of the new invention;

FIG. 2 shows an electrical circuit diagram interrelating the various operative components of the system of FIG. 1;

FIG. 3 is a modified electrical diagram similar to FIG. 2; and

FIG. 4 illustrates a detail of the damper motor and damper blade in an air duct.

DETAILED DESCRIPTION OF THE PREFERRED EMBODIMENT

Referring now to FIG. 1, the basic schematic illustrating the operating principle of the present invention is depicted.

As illustrated, an air ventilation and conditioning system includes a space 10 to be ventilated and a thermostatic controller 12 operative within the space 10. In a typical air conditioning system, the space 10 will be provided with a series of inlet and outlet ducts for providing a flow of conditioned air. Thus, an inlet duct 14 feeds conditioned air into the space 10 and an outlet duct 16 exhausts air from the conditioned space 10. A return duct 18 permits a portion of the exhausted air along the outlet duct 16 to be returned to a mixing area or mixing chamber 20. The mixing chamber 20 receives outside air from the environment surrounding the space to be conditioned from outside air inlet 14A. An outside air thermostatic controller 22 is mounted within the path of the outside air and is employed to sense the temperature and/or other measurable conditions of the outside air to determine its suitability for use in the economizer system. A mixed air thermostatic controller 24 is mounted just downstream from the mixing chamber 20 and is operative to sense the temperature of the mixture resulting from combining the returned air along the duct 18 and the outside air along the duct 14A. Mechanical cooling is achieved by means of a suitable cooling system 26. It will be understood that cooling system 26 may also include additional environmental control devices which are conventional, including heating and other means for causing a flow of air through the space as desired. Such means may include supply and exhaust fans, or other air movement devices which are conventional in systems of this type for conditioning the space 10 as desired. For ease of illustration, the aspect of mechanical cooling as employed in conjunction with the present invention will be discussed.

The proportion of outside air to be mixed with return air is determined by means of the damper drive illustrated generally as 28. As shown, the damper drive means 28 includes a return air damper 30 and an outside air damper 32. An exhaust air damper, 35, 36 may be provided in the portion of the outlet duct beyond the return air duct 18.

In operation, the space thermostatic controller 12 is presettable within a range of temperatures at a particular point desired for the conditioning of the space 10. When the temperature of the space 10 exceeds the preset point of the controller 12, the controller 12 will provide a signal indicating that the space 10 is to be cooled. The outside air controller 22 then provides a determination as to the particular cooling mode, either mechanical or natural. The outside air controller is similarly settable over a range of operating values which may include merely a temperature setting, or an enthalpy setting, the latter determining the total heat content of the outside air. If the outside air controller 22 determines the outside air to be satisfactory for economizer operation, appropriate control signals are provided to the damper control means 28 in a manner which will result in the closing of the return air damper in order to block return air from the return air duct and in opening of the outside air damper 32 in order to allow the passage of outside air to enter the mixing chamber 20. The system is desired to have relatively tight control over a narrow range; the range being determined by the differential inherent within the mixed air thermostat controller 24. When the temperature at the sensing bulb of the mixed air controller 24 rises above the controller set point a circuit is made (closed) between the R-W terminals. During a temperature fall, R-W will open at the set point temperature minus the switch differential. Thus, a stable point will be achieved wherein a certain mixture of outside air and return air produces the desired mixed air temperature. The mixed air thermostatic controller 24 acts to monitor the mixture of air in order to maintain the damper control means 28 in a state whereby the dampers 30 and 32 move about a point permitting the desired mixture of air components. This movement is termed damper modulation. In accordance with the invention, the control means includes a damper drive responding to the state of the mixed air thermostatic controller 24 which will act to control the movement of the dampers by causing them to modulate at a slow and substantially constant rate in either of two directions. By providing the rate of movement of the damper drive to be much slower than that of the response rate of the mixed air controller 24, a modulation, or simulated floating damper movement is achieved. The mixed air controller thereby modulates the damper's control in the relative proportions of outside air and recirculated or returned air to the desired point. The mixed air controller 24 is settable over a range of temperatures, with each setting being provided with a differential or tolerance level within which the sensed temperature may vary. Since the damper drive, in accordance with the invention, is designed to operate in conjunction with the mixed air thermostatic controller 24, it will be evident that at any specific temperature, variations of the mixed air temperature above and below the set point will cause a very slow movement of the dampers controlling the mixture in either of their two respective directions. It will thus be evident that as the temperature now only fluctuates about a fixed point the dampers will follow with a relatively slow modulating movement back and forth in accordance with that changed temperature in order to compensate by adjusting the relative proportion of outside air and recirculated air.

It of course should be noted that should the thermostatic controller 12 call for cooling, and should the outside air controller 22 indicate that outside air is not satisfactory for such cooling purposes, then the mechanical cooling mechanism 26 comes into play and the outside air damper 32 is closed with the return air damper 30 being open.

Referring to FIG. 2, a more detailed illustration of the electrical connections necessary to effect the operation described in conjunction with FIG. 1 is shown. For explanational purposes, the outside air controller is of the enthalpy type, responding to both dry bulb temperature and humidity and thus allowing the use of outdoor air at a higher temperature for free cooling when the humidity is low. A typical unit which may be employed for this purpose is the Honeywell H205A enthalpy controller.

With reference now to FIG. 2, the economizer system, when operative within a complete environmental control system, is locked out during the heating cycle. During the cooling cycle, the system will follow an operation as described generally in connection with FIG. 1. For purposes of illustration, the same reference numberals will be applied to like components in FIG. 2 as were applied in FIG. 1. Thus, when the enthalpy of the outdoor air is below a set point as determined by the outside air thermostatic controller 22, contact is made through terminals 2 and 3. When the space thermostatic controller 12 calls for cooling, the contacts of the controller 12 will close, thus completing the circuit between the R-C terminals and thereby energizing relay R1. Energization of the relay R1 will cause contacts K1 to close, thus completing the circuit between the transformer T1, the mixed air controller 24 and the damper drive means 28. During this control sequence, the outside air damper 32 and the return air damper 30 are modulated by the action of the mixed air controller 24. As will be evident from the circuital connections, during the period of time the relay R1's contacts K1 are closed, and when the mixed air temperature is above the set point contacts WR are closed, thus providing power to the damper drive means 28. As a result of the power application, the damper means 28 acts to move the outside air damper 32 towards a more open position and the return air damper 30 to a more closed position, thereby allowing a greater mixture of outside air in proportion to the amount of recirculated or returned air. It should be noted that during this phase, power is continuously applied to the damper drive 28. The damper drive acts to continually drive the dampers, although at a very slow and substantially constant rate, towards a condition which will result in full opening of the outside air damper and full closure of the returned air damper. If during this period of time the mixed air thermostatic controller 24 should sense a drop in temperature below the set point minus the switch differential contacts WR will open and the contacts RB will close. The opening of the contacts WR thus removes power from the damper drive means 28. Removal of the power from the damper drive means 28 is designed to result in reversal of the movement of the dampers 30 and 32 to their opposite positions. As a result, the dampers 30 and 32 will now move at the same slow and substantially constant rate towards a position resulting in full closure of the outside air damper 32 and full opening of the returned air damper 30. Since the mixed air controller 24 responds very quickly to changes in the mixed air temperature, power will be applied over a period of time in an on and off manner to the damper drive means 28 and the dampers 30 and 32 will slowly move back and forth over a relatively narrow range, thereby causing a modulating condition which provides for precise mixed air temperature control. By proper setting of the mixed air temperature control 24, the temperature of the space 10 may be adequately maintained in accordance with this system's requirements.

The action of the damper drive means 28 can be designed to operate dampers 30 and 32 in a reciprocating manner by a single motor control, or may provide for two individual motors, each controlling a respective damper in opposite directions. Thus, referring to FIG. 2, connections are shown for the operation of a second slave motor coupled in parallel to the damper drive means 28. Thus, application of power to damper drive 28 provides a similar application of power to the parallel slave motor when required. This condition may also be employed to drive a third motor 36 which may be positioned in the exhaust air portion of the outlet duct 16 for further effectuating more precise control of the systems. Clearly, an advantageous situation is realized without the need for linkages or other mechanical contrivances necessary to interconnect series of motors which may be employed for operation of several dampers in accordance with the state of the various controllers within the system.

While the outside air is below the enthalpy point of the controller 22, the mechanical compressor 26 is locked out by failure of power to be applied through its appropriate relay coil as shown connected from the power source through terminal Y in FIG. 2. In this context, contacts 1 and 2 are open, thereby holding the mechanical compressor locked out of the circuit. At the instant when controller 22 switches from mechanical to natural cooling however a predetermined time delay will allow mechanical cooling in order to permit the relatively slow moving dampers to open to a point sufficient to allow the natural cooling to be substituted for the mechanical cooling. When switching from mechanical cooling to natural cooling, the contacts 1,2 on the outside air thermostatic controller 22 open and the contacts 2,3 close. Normally, this would remove the mechanical compressor from the circuit. However, contacts S1 will maintain a closed circuit between the terminal 2 on the panel P and the terminal Y on the panel P, thereby allowing the compressor to continue in the circuit. The contact S1 is opened by means of a cam placed on the drive shaft of the damper driver means 28. The cam begins to rotate with the activation of the damper driver 28 and will open the auxiliary switch S1, thereby breaking the circuit to the compressor at the moment when the damper 32 has rotated to a position allowing sufficient quantities of outside air to enter into the mixing chamber.

Other means of effecting this compressor time delay may be realized. For example, thermoswitching may be employed, electronic time delay, or other means. It is only sufficient that the time delay be long enough to allow the outside air damper 32 sufficient time to partially open before the compressor ceases its operation.

When the enthalpy of the outside air rises above the outside air controller 22, contacts 2 and 3 of the outside air controller 22 break and the relay R1 will drop out. If the space thermostat controller 12 is calling for cooling at this moment, the mechanical cooling will begin operation. At this time, the outside air damper 32 and the return air damper 30 will return to their normal operating positions sufficient to allow mechanical cooling to have maximal effect.

With reference to FIG. 3, an example of an electrical time delay system is employed. In this example, the mechanical cam arrangement has been replaced by an electrical time delay relay R2 and its associated contact. The additional relay R1 contact D2, together with relay R2 and its contact, will maintain a closed circuit between terminal 2 on panel P and terminal Y on panel P thereby allowing the compressor 26 to remain on for a fixed time, until relay R2 contact opens, thus removing power from the compressor.

Conventional components may be employed for each of the various components discussed herein. Thus, the damper drive means is preferably a slow moving reversible motor such as a bimetallic heat motor; a thermally driven motor composed of a bimetallic strip heated by a resistance heating element. As shown in FIG. 4, the heat motor 40 is a bimetallic strip 41 mechanically coupled directly to the damper 42 and can be mounted right on the side of the duct 43. It operates merely by passing an electric current through the resistive element, thereby causing the bimetallic strip to coil, thereby imparting a rotary motion to the damper blade. This is illustrated generally in FIG. 4. One such unit which is acceptable in accordance with the present invention is available from the Honeywell Corporation of Minneapolis, Minn., and is designated as the M833A. Also usable in accordance with the invention are gear or worm drives which perform reductions in speed from standard high speed motors, or direct drive with the speed predetermined by the design of the motor.

The mixed air controller 24 may be of the snap acting switch type with fixed differential, such as Honeywell type T6031A.

In a typical system configuration, the present invention would employ ducts of 36 in. in width and 12 in. in height defining an area of 432 sq. in. In this case, the damper blades when closed would have an area of 432 sq. in. to close one hundred percent of the duct opening. In operation, the dampers would rotate over a range of approximately 90 degrees or less with a time period of 15 minutes to move from fully open to fully closed positions and vice versa.

It is also possible to use a minimal amount of outside air for ventilation purposes, even when in the mechanical mode, by providing a fixed mechanical stop in the outside air damper to prevent it from closing to its fully closed position.

Typical differentials (in degrees Farenheit) for each of the controllers will be $\pm 1\frac{1}{2}°$ for the space controller, $\pm 2°$ at 50% humidity for the outside air or enthalpy controller and $\pm 2°$ for the mixed air controller. The enthalpy controller can also be of the simpler dry bulb variety, with a $\pm 2°$–$3°$ differential, although the total heat content sensing of an enthalpy controller is preferred. The mixed air controller can be set typically at 55° F., the inside and outside air controllers at appropriate typical environmental settings as desired.

The use of the slower constant speed mixed air controlled motor of the present invention thus provides certain advantages in terms of technical simplicity and economics in installation, maintenance and operation. In a dual or multidamper system, the use of the present invention economically allows the use of separate motor controls rather than the conventional linkage system now employed to control a second or further dampers from a single motor.

The time delay mechanism employed can be a Honeywell time delay R8206, preset to allow 90 seconds for the dampers to open after the system switches to a free cooling mode.

Power can be supplied from standard power sources, solar energy, or the like.

It will be understood that the foregoing numerical values are intended as exemplary only and not limiting. Various other dimensional configurations, time delays and temperature settings can be employed with the concept of the present invention. Other substitutions, modifications, variations and deletions within the spirit and scope of the invention will be apparent to those skilled in the art.

What I claim is:

1. An air conditioning system comprising a space thermostat controller for maintaining a range of desired temperature of air in said space, and outside air controller determining the mode of cooling said space when said space thermostat determines said space is to be cooled, said modes including mechanical cooling and natural cooling, a mixing chamber for mixing return air from said space with outside air for natural cooling, damper means for controlling the relative mixture of said return and outside air to said mixing chamber, a mixed air controller positioned with respect to said mixing chamber for sensing the temperature of said mixed air, said mixed air controller settable at a set point temperature within a range of ambient temperatures and having a preset switch differential at any particular temperature, control means coupled to said mixed air controller and responsive to said mixed air controller for adjusting the position of said damper means, said control means including drive means for continuously moving said damper means across its entire operating range in accordance with the state of said mixed air controller, said bidirectional damper means modulating between said set point temperature and said set point temperature minus said switch differential of said mixed air controller, thereby maintaining said desired air temperature in said space, wherein said drive means drives at a slow and substantially constant rate in either of two directions, at a lesser rate than the response rate of the mixed air control, thereby causing said modulating of said damper, the mixed air control reaching the actual mixed air temperature before the dampers can overcompensate.

2. The system of claim 1 wherein said drive means is a bidirectional heat motor.

3. The system of claim 1 wherein said damper means includes reciprocating dampers for said outside air and return air in the form of first and second dampers, and wherein said drive means includes a first heat motor driving said first damper and a second heat motor driving said second damper.

4. The system of claim 1 further including means to lock out said mechanical cooling during said natural cooling mode.

5. The system of claim 4 further including means for delaying said mechanical cooling mode after selection thereof for a period of time to permit said damper means to allow sufficient outside air to enter said mixing chamber.

6. The system of claim 5 wherein said means for delaying is a cam rotatable with said damper means, and an electrical switch, coupled to said cam and electrically coupled to said mechanical cooling to maintain said mechanical cooling operational until said cam contacts said switch.

7. An air conditioning economizer system utilizing natural and mechanical cooling modes, comprising a closed space, an air inlet duct, air outlet duct, air return duct and outside air inlet, said outside air inlet and return duct meeting in a mixing chamber, a space thermostat controller for determining whether said space is to be cooled or not to be cooled, an outside air controller sensing enthalpy of said outside air for determining the mode of cooling said space when said space controller demands cooling, said air return duct and said outside air duct each including a damper, the position of each said damper determining the relative mixture of outside air and recirculated air for said natural cooling mode, a mixed air controller having a preset set point temperature and a preset switch differential temperature setting for sensing the temperature of said mixed air, a damper drive means acting to bidirectionally drive each said damper at a constant rate in opposing directions to control the proportions of said mixture, said drive means responsive to said mixed air controller to drive said dampers until said mixed air controller indicates that its set point has been surpassed, whereupon said drive means reverses the movement of damper drive until said mixed air controller senses an air flow temperature of said set point minus said switch differential, said continuous reversing action of said damper causing a modulating damper condition, thereby providing a desired temperature range within said closed space, wherein said drive means drives at a slow and substantially constant rate in either of two directions, at a lesser rate than the response rate of the mixed air control, thereby causing said modulating of said damper, the mixed air control reaching the actual mixed air temperature before the dampers can overcompensate.

8. The system of claim 7 wherein said drive means is a bidirectional heat motor.

9. The system of claim 7 wherein said damper means includes reciprocating dampers for said outside air and return air in the form of first and second dampers, and wherein said drive means includes a first heat motor driving said first damper and a second heat motor driving said second damper.

10. The system of claim 7 further including means to lock out said mechanical cooling during said natural cooling mode.

11. The system of claim 10 further including means for delaying said mechanical cooling mode after selection thereof for a period of time to permit said damper means to allow sufficient outside air to enter said mixing chamber.

12. The system of claim 11 wherein said means for delaying is a cam rotatable with said damper means, and an electrical switch, coupled to said cam and electrically coupled to said mechanical cooling to maintain said mechanical cooling operational until said cam contacts said switch.

* * * * *

UNITED STATES PATENT AND TRADEMARK OFFICE

CERTIFICATE OF CORRECTION

PATENT NO. : 4,186,564

DATED : February 5, 1980

INVENTOR(S) : Melvin Myers

It is certified that error appears in the above-identified patent and that said Letters Patent are hereby corrected as shown below:

Sheet 1,Figure 2, Change "Entholpy" to --Enthalpy--.

Sheet 2, Figure 3, Change "Temperture" to --Temperature--.

Sheet 3, Figure 3, Change "Entholpy" to --Enthalpy--.

Signed and Sealed this

*Twenty-fourth* Day of *June 1980*

[SEAL]

*Attest:*

SIDNEY A. DIAMOND

*Attesting Officer*

*Commissioner of Patents and Trademarks*